US005902053A

United States Patent [19]

Ikemoto et al.

[11] Patent Number: 5,902,053

[45] **Date of Patent: *May 11, 1999**

[54] VIDEO PRINTER HAVING THERMAL HEAD

[75] Inventors: Yuichiro Ikemoto; Yasushi Hirumi; Hiroshi Katsuno, all of Kanagawa, Japan

[73] Assignee: Sony Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/728,896

[22] Filed: Oct. 10, 1996

[30] Foreign Application Priority Data

Oct. 11, 1995 [JP] Japan ..... 7-263186

[51] Int. Cl.[6] ..... B41J 2/36

[52] U.S. Cl. ..... 400/120.07; 400/120.09

[58] Field of Search ..... 400/120.01, 120.02, 400/120.03, 120.04, 120.07, 120.09; 347/15, 43, 183, 188

[56] References Cited

U.S. PATENT DOCUMENTS

| | | | |
|---|---|---|---|
| 4,952,085 | 8/1990 | Rein | 347/183 |
| 5,297,878 | 3/1994 | Saito et al. | 400/120.02 |
| 5,355,793 | 10/1994 | Sato et al. | 101/129 |
| 5,494,361 | 2/1996 | Sonoda | 400/120.03 |
| 5,565,904 | 10/1996 | Sawano | 347/183 |
| 5,697,712 | 12/1997 | Sato et al. | 400/120.07 |

FOREIGN PATENT DOCUMENTS

| | | |
|---|---|---|
| 4-257459 | 9/1992 | Japan . |
| 4-284780 | 10/1992 | Japan . |

*Primary Examiner*—John Hilten

*Attorney, Agent, or Firm*—Frommer Lawrence & Haug, LLP.; William S. Frommer

[57] ABSTRACT

A recording apparatus according to the present invention has a structure such that recording position of each dot is inverted in one pixel area in such a manner that a direction in which dots of lines in the main scanning direction to be formed on a printing sheet is made to be different from the main scanning direction. Even if the printing sheet feeding apparatus encounters displacement and the position of the printing sheet with respect to a thermal head is displaced, the foregoing structure causes dots to be formed in a zigzag configuration for the lines in the main scanning direction of the printing sheet on which a dot pattern has been formed in accordance with image data so that generation of moire fringes in the main scanning direction is prevented. Since the recording apparatus according to the present invention enables a required printing mode to be selected from a plurality of printing modes for the printing processes for printing yellow, magenta and cyan color components, generation of moire fringes in the main scanning direction can be prevented and change in the hue can be restrained without deterioration in the resolution of the recorded dots even if the position of the magenta dot or the cyan dot is displaced with respect to the position of the yellow dot.

28 Claims, 8 Drawing Sheets

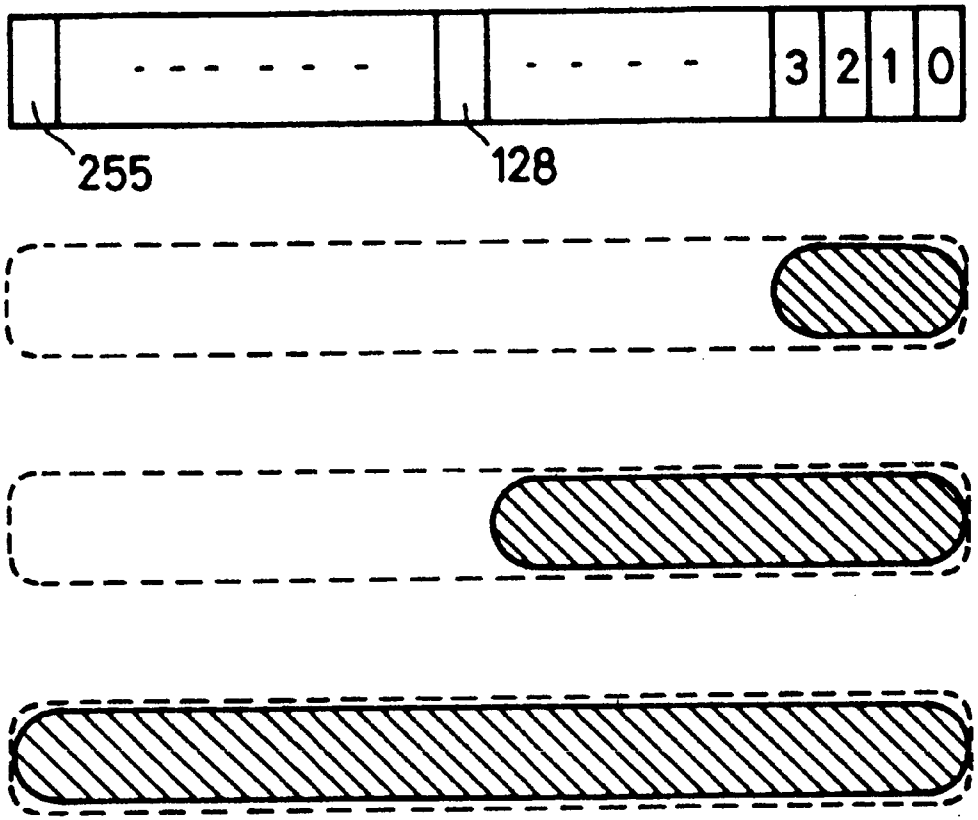
FIG. 3F Inverted Count Data
FIG. 3G Print Dot (3 Gradients)
FIG. 3H Print Dot (127 Gradients)
FIG. 3I Print Dot (255 Gradients)

VIDEO PRINTER HAVING THERMAL HEAD

BACKGROUND OF THE INVENTION

The present invention relates to a recording apparatus for recording image data on a printing sheet. More particularly, the present invention relates to a thermal transfer recording apparatus for recording an image on a printing sheet by operating each thermal head in accordance with the depth of image data to be printed while moving the printing sheet with respect to a thermal head having a plurality of heat generating devices.

A thermal transfer recording apparatus is also called as a thermal transfer printer. The thermal transfer recording apparatus is a recording apparatus having a structure such that a thermal head is pressed against an ink ribbon placed on a printing sheet wound around a cylindrical platen and ink is melted or sublimated so as to transfer color pigment to the surface of the printing sheet. The thermal head has a plurality of heat generating devices (heaters) horizontally forming a line, the heat generating devices being arranged to relatively move for a predetermined length while being brought into contact with the printing sheet. Then, the heat generating devices are caused to generate heat for a period corresponding to the depth of each pixel for each line so that one image is printed.

When a color image is formed by a thermal transfer recording apparatus of the above-mentioned type, three color tones, that is, Y (yellow), M (magenta) and C (cyan) images, or four color tones including K (black), are sequentially printed. The color tone to be realized by printing is expressed by adjusting the degree of superposition of yellow, magenta and cyan components.

When the thermal transfer recording apparatus prints yellow components in a yellow-component printing step, the thermal head is operated while rotating the platen to move the printing sheet with respect to the thermal head so that data of the yellow components is printed. In a next magenta-component printing step in which magenta components are printed, the platen is furthermore rotated to restore the printing sheet to the original position so that magenta components are printed similarly to the yellow-component printing process. In a next cyan-component printing step in which cyan components are printed, the platen is furthermore rotated to similarly restore the printing sheet to the original position so that cyan components are printed similarly to the magenta-component printing process. That is, similar printing steps are repeated three times. If an ideal operation is performed, yellow, magenta and cyan dots are printed at appropriate positions so that an appropriate color is reproduced.

However, the structure arranged such that the platen is rotated to physically locate the printing sheet sometimes encounters a fact that the printing sheet cannot completely be restored to the original position when the magenta-component printing step is performed or the cyan-component printing step is performed. In the above-mentioned case, displacement for several microns takes place at the dot position for each color component. Since the yellow, magenta and cyan dots are linearly arranged in a direction in which the heat generating devices are arranged, that is, in the main scanning direction, displacement of the dot position of each color causes linear moire fringes to be generated in the main scanning direction.

Since yellow, magenta and cyan dots are printed in this sequentially order and the half tones are expressed by adjusting the degree of superposition of the yellow, magenta and cyan components, relative displacement taking place between, for example, the yellow dot and the magenta dot results in a dot having a hue different from a required one being unintentionally formed. That is, color balance is disordered and color confusion takes place.

In view of the foregoing, an object of the present invention is to provide a recording method and a recording apparatus capable of preventing generation of moire fringes and color confusion occurring attributable to displacement of recorded dots.

SUMMARY OF THE INVENTION

A recording apparatus according to the present invention for recording, on a printing sheet, an image corresponding to supplied image data, comprising: head operation means for controlling operation timing and operation period of time of heat generating devices arranged in the main scanning direction of a thermal head in accordance with the depth of image data to be printed; conveyance means for conveying the printing sheet in the sub-scanning direction relatively to the thermal head; and a controller for controlling the head operation means and the conveyance means in such a manner that the position of a dot to be formed in one pixel area of a line in the main scanning direction of the printing sheet is inverted for each dot. A recording apparatus according to the present invention for recording, on a printing sheet, an image corresponding to supplied image data, the recording apparatus comprising: head operation means for controlling operation timing and operation period of time of heat generating devices arranged in the main scanning direction of a thermal head in accordance with the depth of image data to be printed; conveyance means for conveying the printing sheet in the sub-scanning direction relatively to the thermal head; and a controller for controlling the head operation means and the conveyance means in such a manner that the direction of arrangement of dots which are formed in a case where image data having a predetermined depth is printed on the printing sheet is different from the main scanning direction.

Even if the printing sheet feeding apparatus encounters displacement and the position of the printing sheet with respect to a thermal head is displaced, the foregoing structure causes dots to be formed in a zigzag configuration for the lines in the main scanning direction of the printing sheet on which a dot pattern has been formed in accordance with image data so that generation of moire fringes in the main scanning direction is prevented.

A recording apparatus according to the present invention has a first printing mode for forming a first dot pattern having a dot arrangement in substantially the sub-scanning direction, a second printing mode for forming a second dot pattern having a dot arrangement making a second angle from the main scanning direction, a third printing mode for forming a third dot pattern having a dot arrangement making a third angle from the main scanning direction, and a fourth printing mode for forming a fourth dot pattern having a dot arrangement making a fourth angle from the main scanning direction. The controller is further provided with storage means for storing printing process data denoting a printing process corresponding to one color component of a plurality of color components to be printed and printing mode data denoting one of a printing mode among the plural printing modes while making data items to correspond to each other. A required printing mode can arbitrarily be selected from a plurality of printing modes for the printing processes for printing yellow, magenta and cyan color components.

Moreover, generation of moire fringes in the main scanning direction can be prevented and change in the hue can be restrained without deterioration in the resolution of the recorded dots even if the position of the magenta dot or the cyan dot is displaced with respect to the position of the yellow dot.

The recording method according to the present invention comprises the steps of: forming a first dot pattern having first color component dots arranged in a direction making a first angle from the main scanning direction; forming a second dot pattern having second color component dots arranged in a direction making a second angle, which is different from the first angle, from the main scanning direction; and forming a third dot pattern having third color component dots arranged in a direction making a third angle, which is different from the first angle and the second angle, from the main scanning direction. Therefore, generation of moire fringes in the main scanning direction can be prevented and change in the hue can be restrained without deterioration in the resolution of the recorded dots even if the position of the magenta dot or the cyan dot is displaced with respect to the position of the yellow dot.

According to the present invention, the number of heat generating devices of the thermal head with which electric power must be supplied can be halved when an image having a depth lower than a half tone is formed. Therefore, the synthetic resistance of the devices can be reduced and common drop, the voltage drop attributable to the resistance of the power source harness or the like cannot be ignored, can be prevented.

BRIEF DESCRIPTION OF THE DRAWINGS

FIGS. 3*a*, 3*b*, 3*c*, 3*d*, 3*e*, 3*f*, 3*g*, 3*h*, and 3*i* are a schematic views showing dots respectively formed by a normal printing method and a inversion printing method;

DETAILED DESCRIPTION OF THE INVENTION

Preferred embodiments of a thermal transfer recording apparatus according to the present invention will now be described with reference to the drawings.

1. Schematic Description of Recording Method Adapted to Thermal Transfer Recording Apparatus Referring to FIG. 1, the method of recording image data adapted to the thermal transfer recording apparatus according to the present invention will now be described. The thermal transfer recording apparatus according to the present invention has a thermal head 7 having a plurality of heat generating devices and a platen 22 around which a printing sheet 50 is wound. The printing sheet 50 on which image data is transferred is made of wood-free paper and having a surface on which a receptor layer which is a polymer layer having a size of 1 to 2 m is formed. The ink ribbon 60 is made of a condenser sheet on which sublimation transfer yellow, magenta and cyan dyes are sequentially printed.

Figure 1:
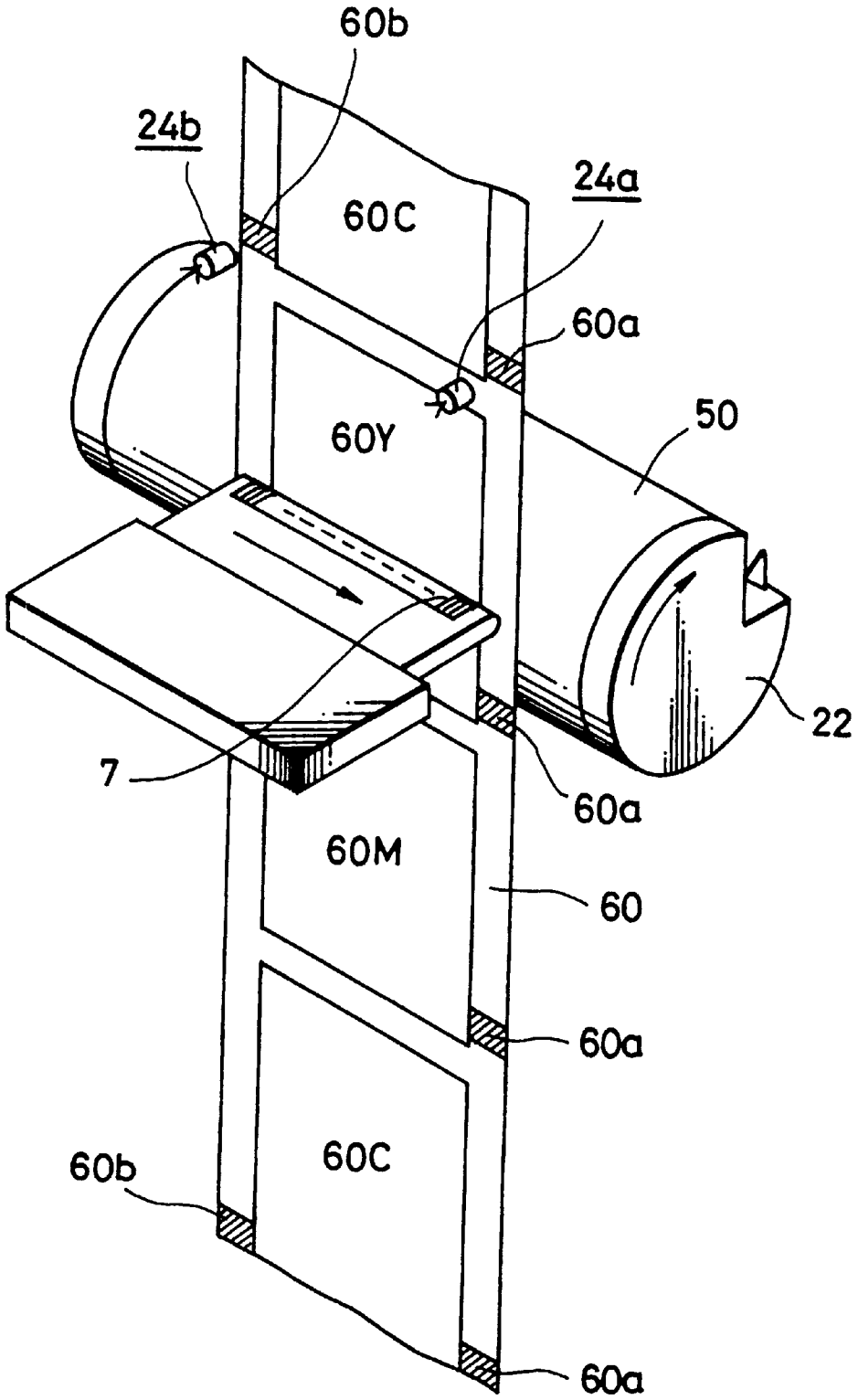
FIG. 1 is a schematic view showing a recording method adapted to a thermal transfer recording apparatus according to the present invention.

Referring to FIG. 1, terms "main scanning direction" and "sub-scanning direction" for use in this specification will now be defined. The main scanning direction is a direction in which the heat generating devices of the thermal head 7 are arranged. The sub-scanning direction is a direction in which the platen 22 is rotated, that is, the printing sheet 50 is moved. Therefore, to print image data on the printing sheet, image data is initially printed in the main scanning direction, and then image data is formed for each line in the sub-scanning direction so that image data for one frame is printed on the printing sheet.

Referring to FIG. 1, the operation of printing image data on the printing sheet will briefly be described. Initially, the printing sheet 50 is wound around the platen 22, and then the platen 22 is rotated so that the printing sheet 50 is located at a position at which the printing operation is started. The ink ribbon 60 has head searching marks 60*a* and 60*b* provided for the ink ribbon 60 and arranged to be detected by photosensors 24*a* and 24*b* so that the ink ribbon 60 is located in such a manner that the leading end of yellow 60Y, which is the color component which is printed first, opposes to the position at which recording is started.

After the printing sheet 50 and the ink ribbon 60 have been located, the thermal head 7 is pressed against the platen 22. When an electric current corresponding to the depth of image data is supplied to each heat generating device of the thermal head 7 in the above-mentioned state, the sublimation dye on the ink ribbon 60 is transferred to the receptor layer on the printing sheet 50. The platen 22 is not fixed in the period in which data for one line is printed but the platen 22 is always rotated slightly. The reason for this lies in that the length of one pixel region in the sub-scanning direction and that of the heat generating device 15 of the thermal head in the sub-scanning direction are not the same but the length of the heat generating device of the thermal head 7 in the sub-scanning direction is shorter than the length of one pixel region in the sub-scanning direction.

In an example case where a recording apparatus according to the present invention has a resolution of 300 dpi (dot per inch), the length of one pixel region in the sub-scanning direction is about 160 mm, while the length of each heat generating device of the thermal head 7 in the sub-scanning direction is about 40 mm. That is, in a period in which data for one line is transferred to the printing sheet 50 by the thermal head 7, the platen 22 is rotated for a distance of 160 mm with respect to the thermal head 7. After the thermal head 7 has transferred yellow component data for all lines to the printing sheet 50, the operation of the yellow component is completed.

After transference of yellow image data to the printing sheet 50 has been performed, the platen 22 is furthermore operated so that the printing sheet 50 is located in such a manner that the position at which printing of the printing sheet 50 opposes to the thermal head 7. The position at which printing is started is the same as the position at which printing of yellow data is started. The ink ribbon 60 is moved in a direction indicated by an arrow (see FIG. 1) so that locating is performed in such a manner that the leading end of magenta 60M opposes to the position at which recording of the printing sheet 50 is started. After the printing sheet 50 and the ink ribbon 60 have been located, the magenta component is transferred similarly to the transference of the yellow component. Similarly, after transference of the magenta component has been completed, transference of the cyan component is performed. Finally, the cyan component is transferred.

As described above, the three color components are superposed on the printing sheet, a color image can be expressed.

2. Description of Overall Structure of Thermal Transfer Recording Apparatus

Figure 2:
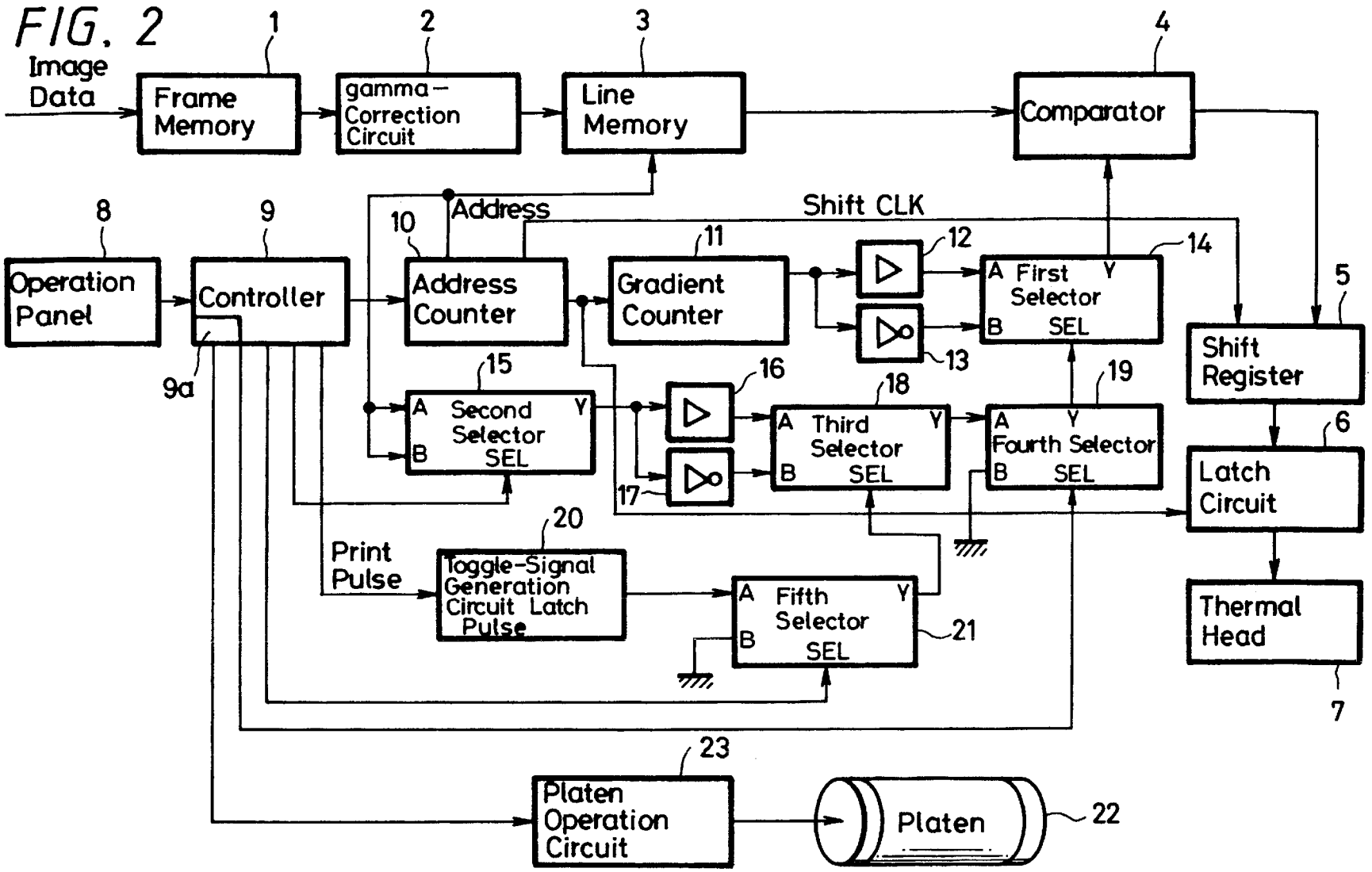
FIG. 2 is a block diagram showing the overall structure of the thermal transfer recording apparatus according to the present invention.

Referring to FIG. 2, the overall structure of the thermal transfer recording apparatus will specifically be described. FIG. 2 is a diagram showing the overall structure of the thermal transfer recording apparatus according to the present invention.

As shown in FIG. 2, the thermal transfer recording apparatus according to the present invention comprises a frame memory 1, a g-correction circuit 2, a line memory 3, a comparator 4, a shift register 5, a latch circuit 6, a thermal head 7, an operation panel 8, a controller 9, an address counter 10 and a gradient counter 11.

The frame memory 1 is a memory for temporarily storing supplied image data and composed of three frame memories for respectively storing yellow, magenta and cyan image data for one frame. Frame data stored in the frame memory 1 is sampled in a vertical direction in accordance with reading address supplied from the controller 9. Therefore, image data for one line sampled in the vertical direction is transmitted from the frame memory 1 for each line.

The g-correction circuit 2 receives image data for one line transmitted from the frame memory 1 for each color component to subject image data to non-linear processes, such as g correction, in accordance with the sensitivity of each ink ribbon. Therefore, the g-correction circuit 2 has three conversion tables on which data for performing the non-linear processes have been written. The line memory 3 receives image data for one line, which has been subjected to the non-linear processes by the g-correction circuit 2, so as to temporarily store image data for one line. Image data for one line stored in the line memory 3 is transmitted for each pixel data in accordance with the reading address supplied from the address counter 10.

The comparator 4 compares image data transmitted from the line memory 3 and count data or inversion count data transmitted from a first selector 14 to each other to transmit data "1" or "0" as data denoting a result of the comparison. The shift register 5 loads data denoting the result of the comparison transmitted from the comparator 4 in accordance with a shift clock supplied from the address counter 10. The latch circuit 6 latches data supplied from the shift register 5 to correspond to each pixel in accordance with a latch pulse supplied from the address counter 10, and supplies latch data to each of the heat generating devices of the thermal head 7. That is, each of the heat generating devices generates heat in only a period in which "1" is transmitted from the comparator 4.

The controller 9 is a circuit for controlling all circuits in the thermal transfer recording apparatus. The controller 9 is a circuit for controlling writing and reading of image data to and from the frame memory 1, counting of the address with respect to the address counter and a selection signal to be transmitted to a selector to be described later. The controller 9 has a memory 9*a* for storing printing process data indicating yellow, cyan and magenta components and printing mode data for instructing first to fourth printing modes to be described later.

The address counter 10 is a circuit for, under control of the controller 9, generating address data for instructing reading of image data for one line stored in the line memory 3. The lowermost bit of reading address data is data which is sequentially inverted whenever one address data is transmitted.

The gradient counter 11 is a circuit for generating count data in accordance with address data supplied from the address counter 10. The gradient counter 11 is composed of two 4-bit counters so as to transmit 8-bit digital count data. The count data is incremental data. The meaning of the count data will be described later.

The thermal transfer recording apparatus further comprises, a buffer 12, an inversion buffer 13, a first selector 14, a second selector 15, a buffer 16, an inversion buffer 17, a third selector 18, a fourth selector 19, a toggle-signal generation circuit 20 and a fifth selector 21.

The buffer 12 buffers count data transmitted from the gradient counter 11 so as to transmit data which is the same as the count data supplied from the gradient counter 11. The inversion buffer 13 inverts the bit of 8-bit count data transmitted from the gradient counter 11 so as to transmit bit-inverted data. Specifically, the inversion buffer 13 inverts the bit of incremental count data supplied from the gradient counter 11 and staring at (00) h and completed at (FF) h to generate decremental data starting at (FF) h and completing at (00) h.

In order to hereinafter distinguish data transmitted from the buffer 12 and data transmitted from the inversion buffer 13 from each other, data transmitted from the buffer 12 is defined to be "normal count data" which is count data, the bit of which is not inverted, while data transmitted from the inversion buffer 13 is defined to be "inverted count data" which is count data, the bit of which has been inverted.

The first selector 14 has an input terminal A for receiving normal count data transmitted from the buffer 12, an input terminal B for receiving inverted count data transmitted from the inversion buffer 13, a selection terminal SEL for receiving a selection signal supplied from the fourth selector 19 and an output terminal Y for transmitting normal count data supplied to the input terminal A or inverted count data supplied to the input terminal B. In accordance with the selection signal supplied from the fourth selector 19, the first selector 14 selects count data supplied to the input terminal A or inverted count data supplied to the input terminal B so as to supply selected data to the comparator 4. The first selector 14 selects normal count data supplied to the input terminal A when the selection signal supplied from the fourth selector 19 is "0" so as to transmit the normal count data to the comparator 4. When the selection signal supplied from the fourth selector 19 is "1", the first selector 14 selects the inverted count data supplied to the input terminal B so as to transmit the inverted count data to the comparator 4.

The second selector 15 has an input terminal A for receiving lowermost bit A1, which is the lowest bit of the address data transmitted from the address counter 10, an input terminal B for receiving lower bit A2 which is the second bit next to the lowermost bit A1, a selection terminal SEL for receiving a selection signal supplied from the controller 9 and an output terminal Y for transmitting the lowermost bit A1 or the second lower bit A2 supplied to the input terminal A to both of the buffer 16 and the inversion buffer 17. Note that the lowermost bit A1 is bit data which is inverted at each dot and which consists of data, such as "0, 1, 0, 1, . . . ". The foregoing data A1 is defined to be "1-dot inverted data". The second lower bit A2 is bit data which is inverted at each 2 bits and consists of data, such as "0, 0, 1, 1, 0, 0, 1, 1, . . . ". The foregoing data A2 is defined to be "2-dot inverted data". The second selector 15 selects 1-dot inverted data A1 supplied to the input terminal A or 2-dot inverted data A2 supplied to the input terminal B so as to transmit selected data through the output terminal Y. The second selector 15 selects the 1-dot inverted data A1 supplied to the input terminal A when the selection signal supplied from the controller 9 is "0" so as to transmit the 1-dot inverted data A1. When the selection signal supplied from the controller 9 is "1", the second selector 15 selects the 2-dot inverted data A2 supplied to the input terminal B so as to transmit the 2-dot inverted data A2.

The buffer 16 buffers bit data supplied from the second selector 15 so as to transmit bit data which is the same as the buffered bit data. The inversion buffer 17 inverts the bit of the bit data supplied from the second selector 15 so as to transmit data, the bit of which has been inverted. In the description of the present invention to be performed hereinafter, data which is transmitted from the buffer 16 and data which is transmitted from the inversion buffer 17 are clearly distinguished from each other by defining data which is transmitted from the buffer 16 to be "normal bit data" which is bit data, the bit of which is not inverted and data which is transmitted from the inversion buffer 17 to be "inverted bit data" which is bit data, the bit of which has been inverted.

The third selector 18 has an input terminal A for receiving the normal bit data transmitted from the buffer 16, an input terminal B for receiving inverted bit data transmitted from the inversion buffer 17, a selection terminal SEL for receiving a selection signal supplied from the fifth selector 21 and an output terminal Y for transmitting the normal bit data supplied to the input terminal A or the inverted bit data supplied to the input terminal B. The third selector 18 selects the normal bit data supplied to the input terminal A or the inverted bit data supplied to the input terminal B in accordance with the selection signal supplied from the fifth selector 21 so as to supply the selected data to the fourth selector 19. When the selection signal supplied from the fifth selector 21 is "0", the third selector 18 selects the normal bit data supplied to the input terminal A so as to transmit the normal bit data to the fourth selector 19. When the selection signal supplied from the fifth selector 21 is "1", the third selector 18 selects the inverted bit data supplied to the input terminal B so as to transmit the inverted bit data to the fourth selector 19.

The fourth selector 19 has an input terminal A for receiving the normal bit data or the inverted bit data transmitted from the third selector 18, an input terminal B grounded to the earth and arranged to be always supplied with data "0", a selection terminal SEL for receiving a selection signal supplied from the controller 9 and an output terminal Y for transmitting the bit data supplied to the input terminal A or the data "0" supplied to the input terminal B to the first selector 14. The fourth selector 19 selects bit data supplied to the input terminal A or data "0" supplied to the input terminal B in accordance with the selection signal supplied from the controller 9 so as to transmit the selected data to the first selector 14. When the selection signal supplied from the controller 9 is "0", the fourth selector 19 selects the bit data supplied to the input terminal A so as to transmit the bit data to the first selector 14. When the selection signal supplied from the controller 9 is "1", the third selector 18 selects data "0" supplied to the input terminal B so as to transmit the data "0" to the first selector 14.

The toggle-signal generation circuit 20 is a circuit which toggles a print pulse supplied from the controller 9 so as to generate a toggled signal which has been toggled. The print pulse is a pulse, the period of which is one line in the sub-scanning direction. Specifically, the toggle-signal generation circuit 20 toggles the supplied print pulse so as to generate an inverted pulse at each leading edge of the print pulse. The generated pulse is a toggle signal. Therefore, the toggle signal is a pulse having a period which is twice the period of the print pulse, that is, a pulse, the period of which is two lines in the sub-scanning direction.

The fifth selector 21 has a input terminal A for receiving the toggle signal supplied from the toggle-signal generation circuit 20, an input terminal B grounded to the earth and arranged to be always supplied with data "0", a selection terminal SEL for receiving a selection signal supplied from the controller 9 and an output terminal Y for supplying the toggle signal supplied to the input terminal A or data "0" supplied to the input terminal B to the selection terminal SEL of the third selector 18. The fifth selector 21 selects the toggle signal supplied to the input terminal A or data "0" supplied to the input terminal B in accordance with the selection signal supplied from the controller 9 so as to transmit the selected data to the third selector 18. When the selection signal supplied from the controller 9 is "0", the fifth selector 21 selects the toggle signal supplied to the input terminal A so as to transmit the toggle signal to the third selector 18. When the selection signal supplied from the controller 9 is "1", the fifth selector 21 selects data "0" supplied to the input terminal B so as to transmit data "0" to the third selector 18.

Moreover, the thermal transfer recording apparatus has the platen 22 around which the printing sheet is wound and arranged to be rotated with respect to the thermal head 7; and a platen operation circuit 23 for controlling the rotation operation of the platen 22 in accordance with a control signal supplied from the controller 9.

3. Description of Recording Method Adapted to Thermal Transfer Recording Apparatus The thermal transfer recording apparatus shown in FIG. 2 is able to form a variety of dot patterns on a printing sheet by selecting two printing methods. One of the printing method is a "normal printing method" and another method is an "inversion printing method" The two printing methods will now be described.

3-1. Normal Printing Method

The normal printing method is a printing method in which the heat generating devices of the thermal head start heat generation at predetermined timing and the same complete heat generation at different timing.

Referring to FIG. 2, the normal printing method will now be described. Initially, the controller 9 controls writing to the frame memory 1 in such a manner that yellow, magenta and cyan image data items supplied from outside are stored in the frame memory 1.

The frame data for one frame stored in the frame memory 1 is sampled in the vertical direction in accordance with the reading address supplied from the controller 9. Then, the frame memory 1 transmits pixel data for one line which has been sampled in the vertical direction for each line.

The g-correction circuit 2 receives each color pixel data for one line transmitted from the frame memory 1 to subject pixel data for each color to the non-linear processes, such as the g correction, in accordance with the sensitivity of each ink ribbon so as to supply the linear-processed data to the line memory 3. The line memory 3 receives pixel data for one line which has been g-processed by the g-correction circuit 2 to temporarily store the pixel data for one line. The pixel data for one line stored in the line memory 3 is, for each pixel data, transmitted to the comparator 4 in accordance with the reading address supplied from the address counter 10.

On the other hand, the gradient counter 11 generates count data in accordance with the address data supplied from the address counter 10. For example, the count data items "0" to "256" are generated in a case of 256 gradients, the generated data being sequentially transmitted to the buffer 12 and the inversion buffer 13. Note that the count data is incremental data which is increased in accordance with address data which is transmitted from the address counter 10.

In the case where the normal printing method is instructed and printing is performed, the controller 9 controls the second selector 15, the fourth selector 19 and the fifth selector 21 in such a manner that the selection signal "0" is always supplied to the selection terminal SEL of the first selector 14. Since the selection signal "0" has been supplied, the first selector 14 transmits, to the comparator 4 through the output terminal Y, the normal count data supplied to the input terminal A.

The comparator 4 compares pixel data transmitted from the line memory 3 and the normal count data transmitted from the first selector 14 with each other. In accordance with a result of the comparison, the comparator 4 transmits data "1" or "0" as data denoting the result of the comparison. That is, each pixel data and the normal count data are compared with each other so that the depth of pixel data can be determined. The process will now be described.

Initially, the controller 9 subjects pixel data for a first line stored in the line memory 3 to the following processes (a), (b) and (c).

(a) Initially, the gradient counter 11 is reset so that the normal count data "0" is supplied to the comparator 4. The normal count data "0" is data denoting a fact that the gradient is the lowest, that is, the depth of the color is lowest. The first selector 14 performs a first process to compare the count data "0" and all of pixel data items of the first line stored in the line memory 3. Specifically, the comparator 4 compares the first pixel data supplied from the line memory 3 and the normal count data to each other. If the pixel data is larger than the normal count data, the comparator 4 transmits "1". If the pixel data is smaller than the normal count data, the comparator 4 transmits "0". Note that when "1" is supplied from the comparator 4 to the register 5, heat generating devices corresponding to the pixel data supplied to the comparator 4 are turned on. When "0" is supplied to the register 5, heat generating devices of the thermal head 7 corresponding to the pixel data supplied to the comparator 4 are turned off. Then, the comparator 4 compares the second pixel data supplied from the line memory 3 and the normal count data with each other. If the pixel data is larger than the normal count data, the comparator 4 transmits "1". If the pixel data is smaller than the normal count data, the comparator 4 transmits "0". Note that the second pixel is a pixel adjacent to the first pixel in the sub-scanning direction. The comparator 4 repeats the foregoing comparison process until the final pixel stored in the line memory 3 is processed.

(b) When the comparator 4 has completed the comparison of the normal count data "0" instructed by the controller 9 with all of the pixel data for the first line stored in the line memory, the controller 9 increases the count data in the gradient counter 11 so that the normal count data is made to be "1". The comparator 4 performs a second process so that the increased count data "1" and all of the pixel data for the first line stored in the line memory 3 are compared with each other similarly to the first process (a) above.

(c) The controller 9 and the comparator 4 repeatedly perform the foregoing process (b) 256 times until the normal count data of the controller 9 is made to be "255". Note that the normal count data "255" denotes that the gradient is the highest. That is, the processes (a) to (c) are processes in which the period of time in which the heat generating device 15 is elongated in proportion to the gradient. That is, the time in which the heat generating device 15 generates heat to correspond to each pixel for one line is supplied as a PWM signal to the thermal head 7.

After the first line stored in the line memory 3 has been subjected to the foregoing processes (a) to (c), the controller 9 controls reading of data from the frame memory 1 to cause the line memory 3 to store pixel data for the second line. Then, the controller 9 subjects pixel data for the second line to the foregoing processes (a) to (c).

After the controller 9 has subjected all lines stored in the frame memory 1 to the foregoing processes (a) to (c), the printing process for one color is completed.

3-2. Inversion Printing Method

The inversion printing method is a printing method in which the heat generating devices of the thermal head complete heat generation at predetermined timing and start heat generation at different timing in accordance with the depth of the supplied pixel data. That is, the heat generation start timing and heat generation completion timing are opposite to each other between the inversion printing method and the normal printing method.

Similarly referring to FIG. 2, the inversion printing method will now be described.

In the case where the normal printing method is instructed and printing is performed, the controller 9 controls the second selector 15, the fourth selector 19 and the fifth selector 21 in such a manner that the selection signal "1" is always supplied to the selection terminal SEL of the first selector 14. Since the selection signal "1" has been supplied, the first selector 14 transmits, to the comparator 4 through the output terminal Y, the inverted count data supplied to the input terminal B.

The comparator 4 compares pixel data transmitted from the line memory 3 and the inverted count data transmitted from the first selector 14 with each other. In accordance with a result of the comparison, the comparator 4 transmits data "1" or "0" as data denoting the result of the comparison. That is, each pixel data and inverted count data are compared with each other so that the depth of pixel data can be determined. The process will now be described.

Initially, the controller 9 subjects pixel data for a first line stored in the line memory 3 to the following processes (a'), (b') and (c').

(a') Initially, the gradient counter 11 is reset so that inverted count data "255" is supplied to the comparator 4. The comparator 4 performs a first process such that the inverted count data "255" and all of pixel data items for a first line stored in the line memory 3 are compared to each other. Specifically, the comparator 4 compares the first pixel data supplied from the line memory 3 and the inverted count data to each other. If the pixel data is larger than the inverted count data, the comparator 4 transmits "1". If the pixel data is smaller than the inverted count data, the comparator 4 transmits "0". Note that when "1" is supplied from the comparator 4 to the register 13, heat generating devices of the thermal head 7 corresponding to the pixel data supplied to the comparator 4 are turned on. When "0" is supplied to the register 13, heat generating devices corresponding to the pixel data supplied to the comparator 4 are turned off.

Then, the comparator 4 compares the second pixel data supplied from the line memory 3 and the inverted count data "255" with each other. If the pixel data is larger than the normal count data, the comparator 4 transmits "1". If the pixel data is smaller than the inverted count data, the comparator 4 transmits "0". The comparator 4 repeats the foregoing comparison process until the final pixel stored in the line memory 3 is processed.

(b') When the comparator 4 has completed the comparison of the inverted count data "255" instructed by the controller 9 with all of the pixel data for the first line stored in the line memory 3, the controller 9 increases the count data in the gradient counter 11. When the count data transmitted from the gradient counter 11 is increased, the inverted count data transmitted from the inversion buffer 13 is deceased. As a result, the inverted count data is made to be "254". The comparator 4 performs a second process so that the decreased inverted count data "254" and all of the pixel data for the first line stored in the line memory 3 are compared with each other similarly to the first process (a') above.

(c') The controller 9 and the comparator 4 repeatedly perform the foregoing process (b') 256 times until the inverted count data supplied to the comparator 4 is made to be "0".

After the first line stored in the line memory 3 has been subjected to the foregoing processes (a') to (c'), the controller 9 controls reading of data from the frame memory 1 to cause the line memory 3 to store pixel data for the second line. Then, the controller 9 subjects pixel data for the second line to the foregoing processes (a') to (c').

After the controller 9 has subjected all lines stored in the frame memory 1 to the foregoing processes (a') to (c'), the printing process for one color is completed.

4. Description of Formed Dots

Referring to FIG. 3, dots formed by the normal printing method and those formed by the inverted printing method will now be described.

FIG. 3 schematically shows dots respectively having 3, 123 and 255 gradients and respectively formed by the normal printing method and the inversion printing method. The dots shown in FIG. 3 are enlarged in the sub-scanning direction so as to easily compare the size of the dots with the respective gradients. In actual, one pixel area indicated by symbol DE is formed into a square-like shape having the same lengths in the main scanning direction and the sub-scanning direction.

Figures 3A, 3B, 3C, 3D, 3E:
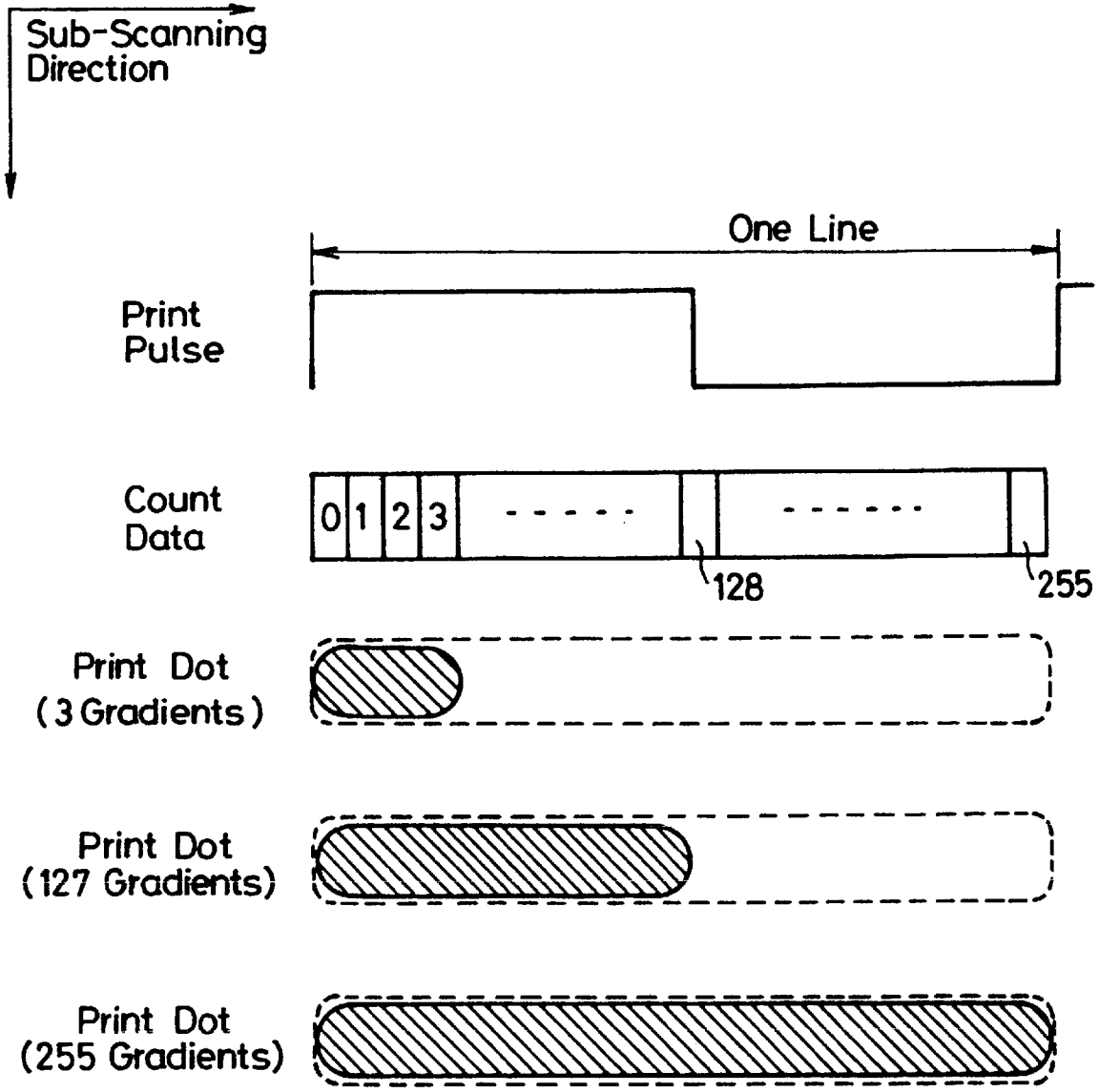

FIG. 3A shows print pulses which are supplied for each line. The print pulse is a pulse, the period of which is one line. FIG. 3B shows a normal count data which is transmitted from the gradient counter 11 through the buffer 12. FIG. 3C shows a dot formed by the normal printing method when the depth of the pixel data is 3 gradients. FIG. 3D shows a dot formed by the normal printing method when the depth of the pixel data is 127 gradients. FIG. 3E shows a dot formed by the normal printing method when the depth of the pixel data is 255 gradients, which is the highest gradient.

Referring to FIGS. 3B to 3D, the dot which is formed by the normal printing method will now be described. When pixel data is printed by the normal printing method, the first selector 14 selects the normal count data transmitted from the buffer 12. Therefore, the comparator 4 is supplied with data which is the same as the count data transmitted from the gradient counter 11.

In the case where the pixel data to be printed is 3 gradients, the heat generating devices of the thermal head 7 corresponding to the pixel data to be printed are turned on in a period when the normal count data is "0" gradient to "3" gradients. During the period in which the heat generating devices are turned on, the printing sheet 50 is moved relatively to the thermal head attributable to the rotation of the platen 22. Therefore, the dot to be formed in one pixel area DE is, as shown in FIG. 3C, formed into a shape elongated in the sub-scanning direction from the end at which printing is started by a degree corresponding to 3 gradients on the basis of the end at which printing is started (the left-hand end of the drawing). The heat generating devices corresponding to the pixel data to be printed are turned off in a period when the normal count data supplied to the comparator 4 is "4" gradients to "255" gradients.

In the case where the pixel data to be printed is 127 gradients, the heat generating devices of the thermal head 7 corresponding to the pixel data to be printed are turned on in a period when the normal count data is "0" gradient to "127" gradients. During the period in which the heat generating devices are turned on, the printing sheet 50 is moved relatively to the thermal head attributable to the rotation of the platen 22. Therefore, the dot to be formed in one pixel area DE is, as shown in FIG. 3D, formed into a shape elongated in the sub-scanning direction from the end at which printing is started by a degree corresponding to 127 gradients on the basis of the end at which printing is started (the left-hand end of the drawing). The heat generating devices corresponding to the pixel data to be printed are turned off in a period when the normal count data supplied to the comparator 4 is "128" gradients to "255" gradients.

In the case where the pixel data to be printed is 255 gradients, the heat generating devices of the thermal head 7 corresponding to the pixel data to be printed are turned on in a period when the normal count data is "0" gradient to "255" gradients, that is, the heat generating devices are always turned on. During the period in which the heat generating devices are turned on, the printing sheet 50 is moved relatively to the thermal head attributable to the rotation of the platen 22. Therefore, the dot to be formed in one pixel area DE is, as shown in FIG. 3E, formed in one pixel area DE into a shape elongated in the sub-scanning direction from the end at which printing is started by a degree corresponding to 255 gradients.

As shown in FIGS. 3C, 3D and 3E, since the print start timing is the same regardless of the gradient, the end at which printing of a dot is started is the same in one pixel area DE. It can be understood that the shape of the formed dot is elongated in the sub-scanning direction in proportion to the depth of the printed pixel data. That is, as shown in FIGS. 3C to 3E, the print start timing at which the heat generation operations of the heat generating devices are started are the same regardless of the pixel in the normal printing method. Moreover, the print completion timing at which the heat generation operations of the heat generating devices are completed are different for each pixel in accordance with the depth of each pixel data.

Referring to FIGS. 3F to 3I, a dot to be formed by the inversion printing method will now be described. FIG. 3F shows inverted count data to be transmitted from the inversion buffer 13. FIG. 3G shows a dot formed by the inversion printing method when the depth of pixel data to be printed is 3 gradients. FIG. 3H shows a dot formed by the inversion printing method when the depth of pixel data to be printed is 127 gradients. FIG. 3I shows a dot inversion printing method when the depth of pixel data to be printed is 255 gradients which is the highest gradient.

When pixel data is printed by the inversion printing method, the first selector 14 selects the inverted count data transmitted from the inversion buffer 13. Therefore, the comparator 4 is supplied with inverted count data, the bit has been inverted with respect to the count data transmitted from the gradient counter 11.

In the case where the pixel data to be printed is 3 gradients, the heat generating devices corresponding to the pixel data to be printed are turned off in a period when the inverted count data to be supplied to the comparator 4 is "255" gradients to "4" gradients. Then, the heat generating devices corresponding to the pixel data to be printed are turned on when inverted count data indicating "3" gradients has been supplied from the inversion buffer 13 to the comparator 4. The state where the heat generating devices are turned on as described above is maintained until inverted count data indicating "0" gradient is supplied to the comparator 4. During the period in which the foregoing heat generating devices are turned on, the printing sheet 50 is moved relatively to the thermal head attributable to the rotation of the platen 22. Therefore, a dot is, as shown in FIG. 3G, formed which has a length corresponding to 3 gradients in one pixel area DE on the basis of the end at which printing is completed (the right-hand end of the drawing).

In the case where the pixel data to be printed is 127 gradients, the heat generating devices corresponding to the pixel data to be printed are turned off in a period when the inverted count data to be supplied to the comparator 4 is "255" gradients to "128" gradients. Then, the heat generating devices corresponding to the pixel data to be printed are turned on when inverted count data indicating "127" gradients has been supplied from the inversion buffer 13 to the comparator 4. The state where the heat generating devices are turned on as described above is maintained until inverted count data indicating "0" gradient is supplied to the comparator 4. During the period in which the foregoing heat generating devices are turned on, the printing sheet 50 is moved relatively to the thermal head attributable to the rotation of the platen 22. Therefore, a dot is, as shown in FIG. 3H, formed which has a length corresponding to 127 gradients in one pixel area DE on the basis of the end at which printing is completed (the right-hand end of the drawing).

In the case where the pixel data to be printed is 255 gradients, the heat generating devices corresponding to the pixel data to be printed are turned on in a period when the inverted count data to be supplied to the comparator 4 is "255" gradients to "0" gradients, that is, the heat generating devices are always turned on. During the period in which the foregoing heat generating devices are turned on, the printing sheet 50 is moved relatively to the thermal head attributable to the rotation of the platen 22. Therefore, a dot is, as shown in FIG. 3I, formed which has a length corresponding to 256 gradients in one pixel area DE on the basis of the end at which printing is completed (the right-hand end of the drawing).

As shown in FIGS. 3G, 3H and 3I, the timing at which printing is completed is the same regardless of the gradient. Therefore, the end of the formed dot in the one pixel area DE is the same. It can be understood that the shape of the formed dot is elongated in a direction opposite to the sub-scanning direction on the basis of the end at which printing is completed in proportion to the depth of pixel data to be printed. That is, as shown in FIGS. 3G, 3H and 3I, the printing completion timing at which the heat generating operations of the heat generating devices are completed is the same regardless of the pixel. The print start timing at which the heat generating operations of the heat generating devices are started are different for each pixel in accordance with the depth of each pixel data.

5. Description of Printing Mode

In this embodiment, a plurality of printing modes are realized by combining the normal printing method and the inversion printing method. The plural printing modes will now be described. FIGS. 4 to 7 schematically show dot patterns respectively formed by plural printing modes in an example case where a half tone dot having about 127 gradients is formed.

Figure 4:
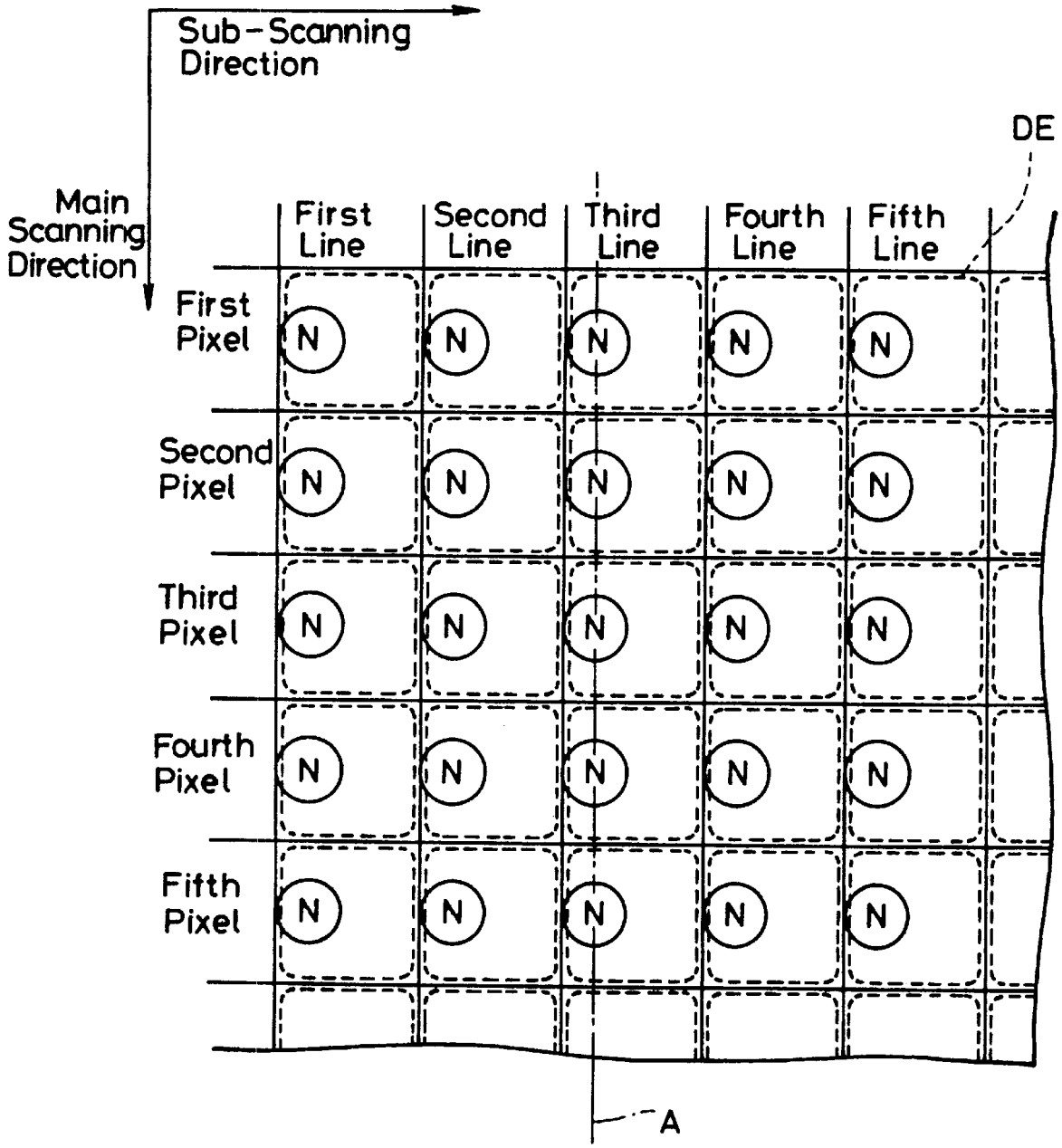
FIG. 4 shows a dot pattern formed by a first printing mode.
Figure 5:
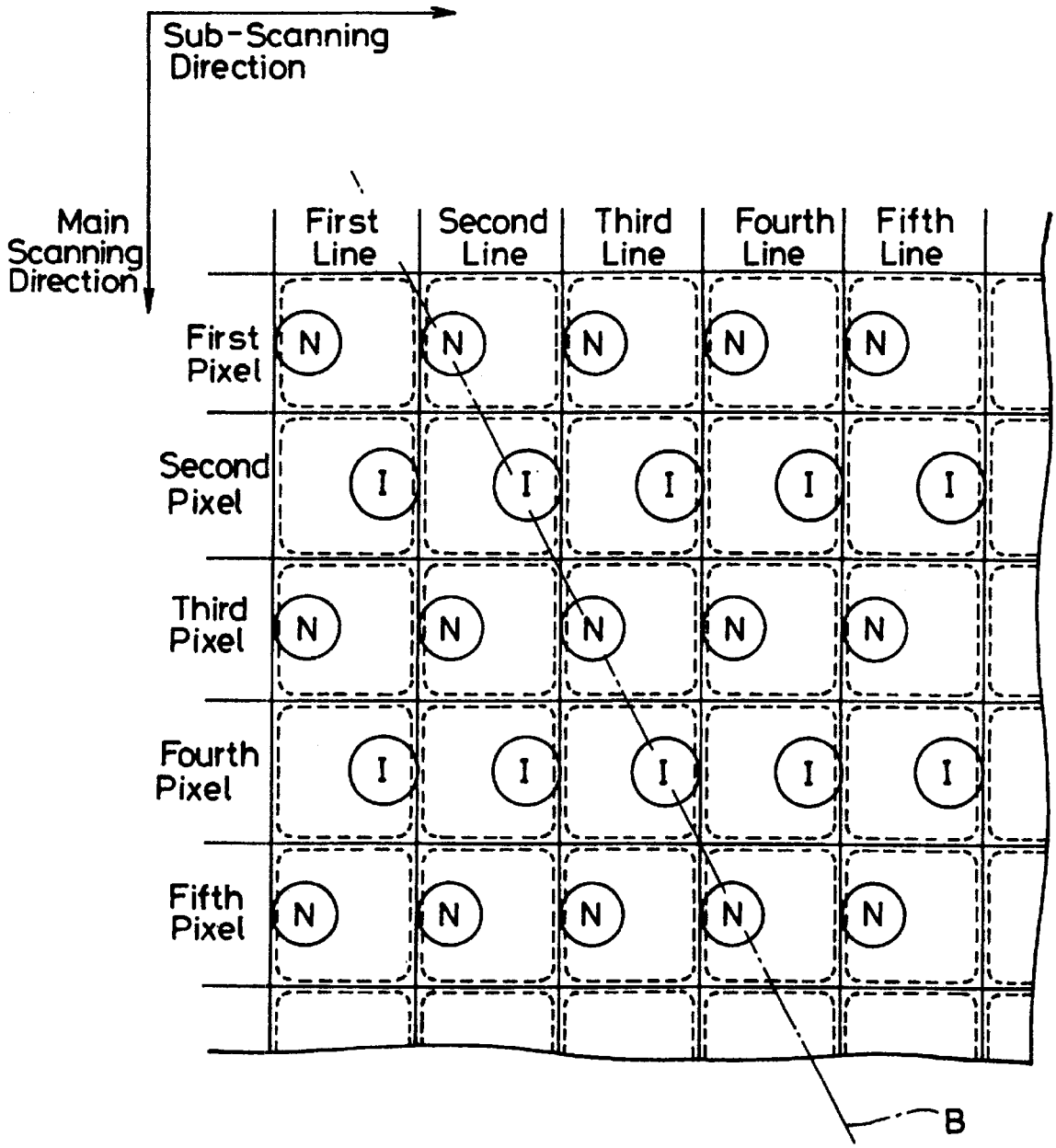
FIG. 5 shows a dot pattern formed by a second printing mode.
Figure 6:
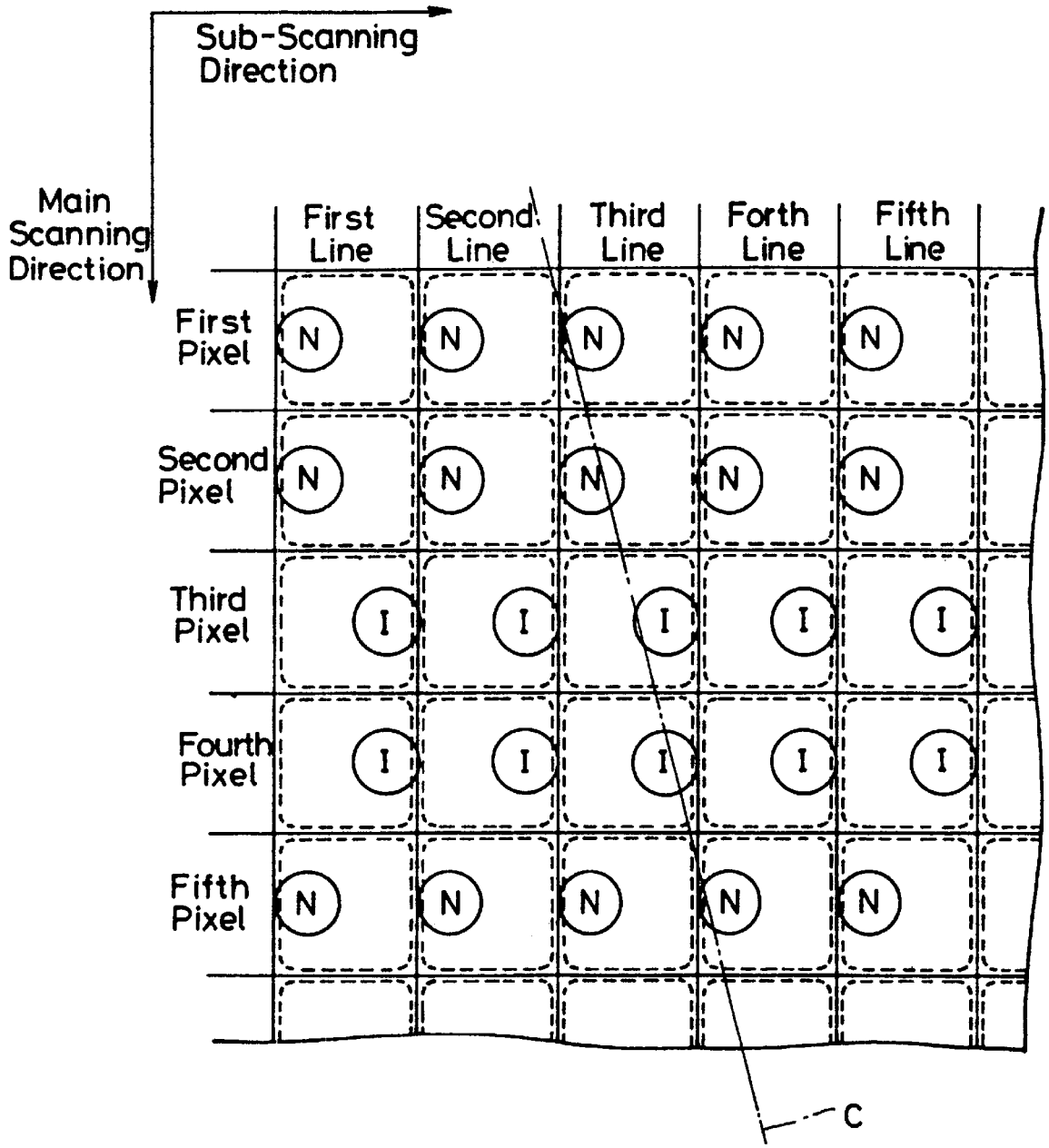
FIG. 6 shows a dot pattern formed by a third printing mode.
Figure 7:
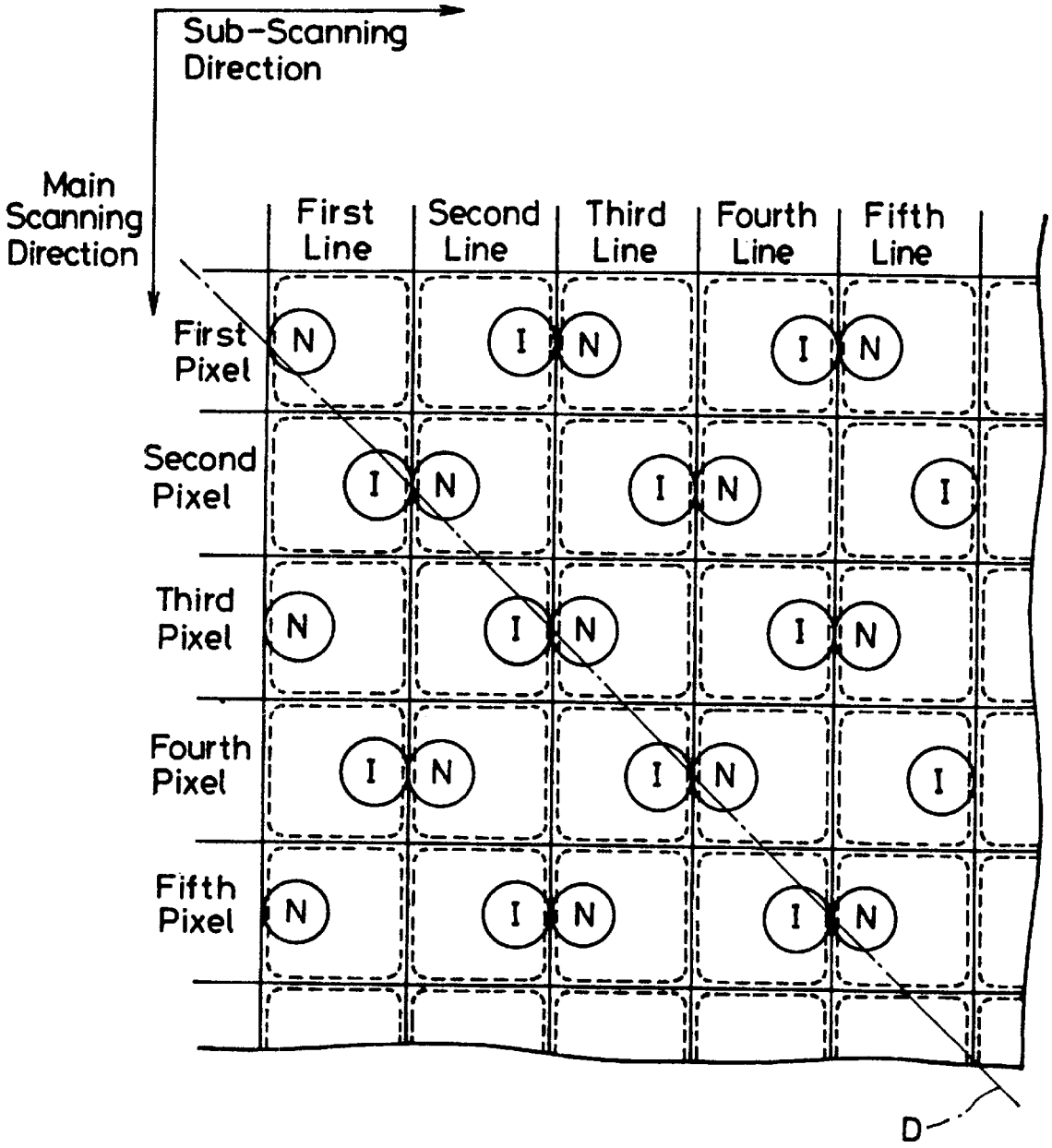
FIG. 7 shows a dot pattern formed by a fourth printing mode.

FIG. 4 shows a dot pattern formed by a first printing mode. FIG. 5 shows a dot pattern formed by a second printing mode. FIG. 6 shows a dot pattern formed by a third printing mode. FIG. 7 shows a dot pattern formed by a fourth printing mode. Referring to FIGS. 4 to 7, dots indicated by a symbol "N" are dots formed by the normal printing method, while dots indicated by a symbol "I" are dots formed by the inversion printing method.

5-1. First Printing Mode

Referring to FIG. 4, the first printing mode will now be described. The first printing mode is a printing method in which all of pixel data items are printed by the normal printing method. As can be understood from FIG. 4, forming of all dots is started at the same left-hand end in one pixel area DE (see FIG. 4). Therefore, the direction in which the formed dots are arranged is expressed by straight line A having an angle of 0° with respect to the main scanning direction.

Referring to FIG. 2, specific operations of the circuits for performing the first printing mode will now be described. When the first printing mode is performed, the controller 9 always supplies "1" serving as a selection signal to the fourth selector 19. Since the fourth selector 19 has been supplied with "1" as the selection signal, the fourth selector 19 supplies, to the selection terminal SEL, data "0" which has been supplied to the input terminal B of the fourth selector 19. Since the first selector 14 is supplied with "0" as the selection signal, the first selector 14 supplies normal count data, which has been supplied to the input terminal A, to the comparator 4. That is, as far as "1" is, as the selection signal, supplied to the fourth selector 19, "0" is always supplied to the selection terminal SEL of the first selector 14. Therefore, dots of all pixel data items can be formed by the normal printing method.

5-2. Second Printing Mode

The second printing mode is, as shown in FIG. 5, a printing method in which odd-order pixel data in the main scanning direction is printed by the normal printing method and even-order pixel data in the main scanning direction is printed by the inversion printing method. Note that odd-order pixel data in the main scanning direction is pixel data expressed by "i=2n−1" (where n=1, 2, 3, . . . ) assuming that the pixel number is "i", while even-order pixel data in the main scanning direction is pixel data expressed by "i=2n. Therefore, the positions, at which printing of the odd-order dots for all lines in the main scanning direction is started, coincide with the left-hand end (see FIG. 5) in one pixel area DE. On the other hand, the positions, at which printing of the even-order dots for all lines in the main scanning direction is started, coincide with the right-hand end (see FIG. 5) in one pixel area DE. That is, as shown in FIG. 5, the dot configuration is formed into a zigzag shape in which dots are disposed at each dot in the main scanning direction. As can be understood from FIG. 5, the direction in which the formed dots are arranged is expressed by straight line B having an angle of 26° with respect to the main scanning direction.

Referring to FIG. 2, specific operations of the circuits for performing the second printing mode will now be described. When the second printing mode is performed, the controller 9 supplies "0" serving as a selection signal to the second selector 15, "0" serving as a selection signal to the fourth selector 19 and "1" serving as a selection signal to the fifth selector 21.

Since the selection terminal SEL of the second selector 15 has been, as the selection signal, supplied with "0" from the controller 9, the second selector 15 transmits one-dot inverted data A1 supplied to the input terminal A of the second selector 15. The one-dot inverted data A1 is bit data which is inverted for each pixel and consists of data such as "0, 1, 0, 1, . . .". The one-dot inverted data is supplied to the input terminal A of the third selector 18 through the buffer 16 and as well as the bit of the one-dot inverted data is inverted so as to be supplied to the input terminal B of the third selector 18.

Since the selection terminal SEL of the fifth selector 21 has been, as the selection signal, supplied with "1" from the controller 9, the fifth selector 21 transmits, to the third selector 18, data "0" supplied to the input terminal B of the fifth selector 21. Since the selection terminal SEL of the third selector 18 has therefore been supplied with "0" as the selection signal from the fifth selector 21, the third selector 18 selects one-dot inverted data supplied to the input terminal A of the third selector 18, the one-dot inverted data being supplied to the input terminal A of the shift register 5.

Since the selection terminal SEL of the fourth selector 19 has been supplied with "0" as the selection signal from the controller 9, the fourth selector 19 selects the one-dot inverted data supplied to the input terminal A of the fourth selector 19, the one-dot inverted data being supplied to the selection terminal SEL of the first selector 14. Therefore, the selection terminal SEL of the first selector 14 is supplied with data which is expressed as "0, 1, 0, 1, 0, . . . " which is inverted for each pixel.

Since the selection terminal SEL of the first selector 14 has been supplied with data expressed as "0, 1, 0, 1, 0, . . . " and inverted for each pixel, the first selector 14, for each dot, alternately selects the normal count data supplied to the input terminal A of the first selector 14 and the inverted count data supplied to the input terminal B. When the normal count data has been selected by the first selector 14, dots are formed by the normal printing method. When the inverted count data has been selected, dots are formed by the inversion printing method. Therefore, the second printing mode causes dots formed by the normal printing method and dots formed by the inversion printing method to be alternately arranged for each dot. As a result, a pattern in which dots are arranged in a zigzag shape is formed in the line in the main scanning direction.

Although an example has been described with reference to FIG. 5 in which the odd-order dots are formed by the normal printing method and the even-order dots are formed by the inversion printing method, the odd-order dots may be formed by the inversion printing method and the even-order dots may be formed by the normal printing method.

5-3. Third Printing Mode

The third printing mode is a printing method in which, as shown in FIG. 6, dots formed by the normal printing method and dots formed by the inversion printing method are arranged in each 2 dots in the main scanning direction. That is, dots expressed by i=(4n−3) and i=(4n−2) in the line in the main scanning direction are dots formed by the normal printing method, while dots expressed by i=(4n−1) and i=4n are dots formed by the inversion printing method. Therefore, printing of the dots of all lines in the main scanning direction expressed by i=(4n−3) and i=(4n−2) is started at the left-hand end (see FIG. 6) in the one pixel area DE, while printing of dots expressed by (4n−1) and i=4n is completed at the right-hand end (see FIG. 6) in the one pixel area DE. As can be understood from FIG. 6, the direction in which the formed dots are arranged is expressed by straight line C having an angle of 14° with respect to the main scanning direction.

Referring to FIG. 2, specific operations of the circuits for performing the third printing mode will now be described. When the third printing mode is performed, the controller 9 supplies "1" as the selection signal to the second selector 15, "0" as the selection signal to the fourth selector 19 and "1" as the selection signal to the fifth selector 21.

Since the selection terminal SEL of the second selector 15 has been supplied with "1" as the selection signal from the controller 9, the second selector 15 selects two-dot inverted data A2 which has been supplied to the input terminal B of the second selector 15. The two-dot inverted data A2 is bit data which is inverted at each two pixels and which consists of data, such as "0, 0, 1, 1, 0, 0, 1, 1, . . . , ". The two-dot inverted data is supplied to the input terminal A of the third selector 18 through the buffer 16 and as well as the bit of the same is inverted by the inversion buffer 17 so as to be supplied to the input terminal B of the third selector 18.

Since the selection terminal SEL of the fifth selector 21 has been supplied with "1" as the selection signal from the controller 9, the fifth selector 21 selects data "0", which has been supplied to the input terminal B of the fifth selector 21, the data "0" being transmitted to the third selector 18. Therefore, the selection terminal SEL of the third selector 18 has been supplied with "0" as the selection signal from the fifth selector 21. Thus, the third selector 18 selects two-dot inverted data A2 supplied to the input terminal A of the third selector 18, the two-dot inverted data being supplied to the input terminal A of the fourth selector 19.

Since the selection terminal SEL of the fourth selector 19 has been supplied with "0" as the selection signal from the controller 9, the fourth selector 19 selects the two-dot inverted data supplied to the input terminal A of the fourth selector 19, the two-dot inverted data being supplied to the selection terminal SEL of the first selector 14. Thus, the selection terminal SEL of the first selector 14 is supplied with data expressed as "0, 0, 1, 1, 0, 0, 1, 1, . . . , " and inverted at each 2 pixels.

Therefore, the selection terminal SEL of the first selector 14 is supplied with data expressed as "0, 0, 1, 1, 0, 0, 1, 1, . . . ," and inverted at each 2 pixels. Therefore, the first selector 14 alternately selects, for each 2 dots, normal count data supplied to the input terminal A of the first selector 14 and inverted count data supplied to the input terminal B. When the first selector 14 has selected the normal count data, dots are formed by the normal printing method. When inverted count data has been selected, dots are formed by the inversion printing method. Therefor, as shown in FIG. 6, the third mode results in dots formed by the normal printing method and dots formed by the inversion printing method being arranged alternately in the main scanning direction.

Although the description has been performed with reference to FIG. 6 in which the dots of the lines in the main scanning direction expressed by i=(4n−3) and i=(4n−2) are formed by the normal printing method and dots expressed by i=(4n−1) and i=4n are formed by the inversion printing method, the dots of the lines in the main scanning direction expressed by (4n−3) and i=(4n−2) may be formed by the inversion printing method and the dots expressed by i=(4n−1) and i=4n may be formed by the normal printing method.

5-4. Fourth Printing Mode

The fourth printing mode is, as shown in FIG. 7, a printing method in which dots in the main scanning direction formed by the normal printing method and dots formed by the inversion printing method are arranged at each dot and dots in the sub-scanning direction formed by the normal printing method and dots formed by the inversion printing method are arranged at each dot. That is, dots expressed by i=(2n−1)

of the line expressed by j=(2n−1) are dots formed by the normal printing method, while dots expressed by i=2n are dots formed by the inversion printing method. On the other hand, dots expressed by i=(2n−1) of the line expressed by j=2n are dots formed by the inversion printing method, while dots expressed by i=2n are dots formed by the normal printing method. Therefore, the position expressed by (i, j)=(2n−1, 2n−1) and (2n, 2n) at which printing of a dot starts is at the right-hand end in the one pixel area DE (see FIG. 7). The position expressed by (i, j)=(2n−1, 2n) and (2n, 2n−1) at which printing of a dot is completed coincides with the right-hand end (see FIG. 7) of the one pixel area DE. As can be understood from FIG. 7, the direction in which the formed dots are arranged is expressed by straight line D having an angle of 45° with respect to the main scanning direction.

Referring to FIG. 2, the specific operations of the circuits for performing the fourth printing mode will now be described. When the fourth printing mode is performed, the controller 9 supplies "0" as the selection signal to the second selector 15, "0" as the selection signal to the fourth selector 19 and "0" as the selection signal to the fifth selector 21.

Since the selection terminal SEL of the second selector 15 has been supplied with "0" as the selection from the controller 9, the second selector 15 selects one-dot inverted data A1 supplied to the input terminal A of the second selector 15. The one-dot inverted data A1 is bit data which is inverted for each pixel and consists of data, such as "0, 1, 0, 1, 0, 0, . . .". The one-dot inverted data is supplied to the input terminal A of the third selector 18 through the buffer 16 as well as the bit of the same is inverted by the inversion buffer 17 so as to be supplied to the input terminal B of the third selector 18.

On the other hand, the input terminal A of the fifth selector 21 is supplied with the signal from the toggle-signal generation circuit 20. The toggle signal is a pulse which is inverted at each leading edge of a print pulse, the period of which is one line. In this embodiment, the toggle signal is a pulse which is, on the line expressed by j=(2n−1), made to be "0" and, on the line expressed by j=2n, made to be "1". That is, the toggle signal is data which is inverted for each line and in the form of, for example, "0, 1, 0, 1, 0, . . . , ". Since the selection terminal SEL of the fifth selector 21 has been supplied with "0" as the selection signal from the controller 9, the fifth selector 21 selects the toggle signal supplied to the input terminal A of the fifth selector 21 and supplies the toggle signal to the selection terminal SEL of the third selector 18.

Since the selection terminal SEL of the third selector 18 has been supplied with the toggle signal as the selection signal form the fifth selector 21, the third selector 18 alternately selects, for each line, one-dot inverted data supplied to the input terminal A and one-dot inverted data inverted and supplied to the input terminal B and supplies the selected data to the input terminal A of the fourth selector 19. Specifically, since the toggle signal is "0" on the line expressed by j=(2n−1), the third selector 18 selects the one-dot inverted data supplied to the input terminal A. Since the toggle signal is "1" on the line expressed by j=2n, the third selector 18 selects the one-dot inverted data inverted and supplied to the input terminal B.

Since the selection terminal SEL of the fourth selector 19 has been supplied with "0" as the selection signal from the controller 9, the fourth selector 19 selects the data supplied to the input terminal A of the fourth selector 19 and supplies the selected data to the selection terminal SEL of the first selector 14.

Therefore, the selection terminal SEL of the first selector 14 is supplied with "0" for the line expressed by j=(2n−1) when i=2n−1. When i=2n, "1" is supplied. That is, data expressed by "0, 1, 0, 1, 0, 1, . . . , " and inverted at each dot is supplied. On the other hand, "1" is supplied for the line expressed by j=2n when i=2n−1. When i=2n, "0" is supplied. That is, data expressed by "1, 0, 1, 0, 1, 0, . . . , " and inverted for each dot is supplied.

Therefore, data expressed as "0, 1, 0, 1, 0, 1, . . . , " and inverted for each pixel is supplied to the selection terminal SEL of the first selector 14 for the line expressed by j=(2n−1). Thus, the first selector 14 alternately selects normal count data supplied to the input terminal A and inverted count data supplied to the input terminal B whenever one dot is printed. For the line expressed by j=2n, the selection terminal SEL of the first selector 14 has been supplied with data expressed as "1, 0, 1, 0, 1, 0, . . . , " and inverted for each pixel. Therefore, the first selector 14 alternately selects inverted count data supplied to the input terminal B and normal count data supplied to the input terminal A whenever one dot is printed.

When the normal count data has been selected by the first selector 14, dots are formed by the normal printing method. When the inverted count data has been selected, dots are formed by the inversion printing method. Therefore, in the fourth mode, dots expressed by (i, j)=(2n−1, 2n−1) and (2n, 2n) are dots formed by the normal printing method, while dots expressed by (i, j)=(2n−1, 2n) and (2n, 2n−1) are dots formed by the inversion printing method, as shown in FIG. 7.

Although the description has been performed with reference to FIG. 7 such that dots expressed by (i, j)=(2n−1, 2n−1) and (2n, 2n) are dots formed by the normal printing method and dots expressed by (2n−1, 2n) and (2n, 2n−1) are dots formed by the inversion printing method, a structure may be employed in which the dots expressed by (i, j)=(2n−1, 2n−1) and (2n, 2n) are dots formed by the inversion printing method and dots expressed by (2n−1, 2n) and (2n, 2n−1) are dots formed by the normal printing method.

5-5. Another Printing Method

Dots formed by the first to fourth printing modes described with reference to FIGS. 4 to 7 are not limited to the foregoing description. For example, the third printing mode may be arranged such that the normal printing method and the inversion printing method may be switched for each 2 dots, or 3 dots or 4 dots. Although the fourth printing mode has the structure such that the normal printing method and the inversion printing method are switched for each line, the normal printing method and the inversion printing method may be switched for each 2 lines or 3 lines. Although the normal printing method and the inversion printing method are switched for each dot in addition to switching for each 2 lines or 3 lines, a structure may be added in which the normal printing method and the inversion printing method are switched for each dots and 3 dots. Any printing method formed by combining the normal printing method and the inversion printing method is included in the scope of the present invention.

The angles of the straight lines corresponding to the direction in which the dots formed by the second, third and the fourth printing modes are arranged are measured values which are results of printing of dots of 127 gradients. If the printing depth varies, the angle, of course, is made to be different. If the printing depth is lowered, the angle of each of the lines B, C and D with respect to the main scanning direction is enlarged. If the printing depth is raised, the angle of each of the lines B, C and D with respect to the main scanning direction is reduced. In general, the highest density dots are used when characters or a figure is printed. In the case where the characters or a figure or the like is formed with the deepest dots, angles of the straight lines B, C and D corresponding to the direction in which the dots formed by the second, third and fourth printing modes are arranged are made to be 0° which substantially coincides with the main scanning direction. Therefore, even if the characters or a figure is printed by the second, third and the fourth printing modes, disorder of the lines of the characters or the figure can be prevented.

6. Correspondence between Color Component and Printing Method

The correspondence between yellow, magenta and cyan and the printing modes will now be described.

It might be feasible to employ the second printing mode for printing all of yellow, magenta and cyan. If the second printing mode is employed, dots are formed such that dots for each line are arranged in a zigzag configuration in the main scanning direction. Therefore, each of yellow, magenta and cyan dots has an arrangement direction of 26° with respect to the main scanning direction. As a result, generation of moire fringes in the main scanning direction can be prevented while preventing deterioration in the resolution.

Similarly, a method may be employed in which the third printing mode or the fourth printing mode is employed to print all of yellow, magenta and cyan images. If the third printing mode is employed, dots are, for each line, arranged in the zigzag configuration at each two dots in the main scanning direction. Therefore, each of the formed yellow, magenta and cyan dots is arranged to make an angle of 14° with respect to the main scanning direction. When the fourth printing mode is employed, dots for each line are formed such that each dot is arranged in the zigzag configuration in the main scanning direction and each dot is arranged in the zigzag configuration in the sub-scanning direction. Therefore, each of yellow, magenta and cyan dots formed by the fourth printing mode is arranged to make an angle of 45° with respect to the main scanning direction. Therefore, either of the third printing mode or the fourth printing mode is able to prevent generation of moire fringes in the main scanning direction without deterioration in the resolution.

A method may be employed in which yellow, magenta and cyan images are printed by different printing modes. A method may be employed in which yellow components are printed by the second printing mode, magenta components are printed by the third printing mode and the cyan components are printed by the fourth printing mode. In this case, yellow dots are arranged to make an angle of 26° with respect to the main scanning direction, magenta dots are formed to make an angle of 16° with respect to the main scanning direction and cyan dots are arranged to make an angle of 45° with respect to the main scanning direction. As a result, even if magenta dots or cyan dots are displaced from yellow dots, hue change of printed image data can be prevented.

The present invention is not limited to the foregoing description. Printing of the respective color components and the printing modes may arbitrarily be combined with one another. For example, a method may be employed in which yellow components are printed by the second printing mode and magenta and cyan components are printed by the third printing mode. Another method may be employed in which yellow components are printed by the fourth printing mode, magenta components are printed by the second printing mode and the cyan components are printed by the third printing mode. Thus, any combination may be employed to realize the present invention.

An optimum combination may arbitrarily be determined as a result of several trials of actual printing operations.

A case where the printing mode is set for each color component will now be described.

Initially, an operator is able to set a required printing mode for each color component (yellow, magenta and cyan) by using the operation panel 8. An example case will now be described in which the operator sets such that yellow components are printed by the fourth printing mode, magenta components are printed by the second printing mode and cyan components are printed by the third printing mode. In this case, the memory 9*a* of the controller 9 stores printing process data denoting the process for printing yellow components and printing mode data denoting the fourth printing mode while relating the data items to each other, printing process data denoting the process for printing magenta components and printing mode data denoting the second printing mode while relating the data items to each other and printing process data denoting the process for printing cyan components and printing mode data denoting the third printing mode while relating the data items to each other. That is, printing process data and printing mode data are related to each other so as to be stored in the memory 9*a* as table form data. Thus, setting of the printing mode is completed.

The operation of printing image data on a printing sheet will briefly be described. Initially, the controller 9 prepares for performing an initial process for printing yellow components. The controller 9 causes the line memory 3 to store yellow image data for one line. Simultaneously, the controller 9 makes a reference to data stored in the memory 9*a* to recognize the printing mode set for the yellow component printing process. Since the fourth printing mode is selected in this embodiment, the controller 9 supplies, as selection signals, "0", "0" and "0" to the second selector 15, the fourth selector 19 and the fifth selector 21. As described above, the controller 9 makes a reference to printing mode data previously stored in the memory 9*a* so that the printing mode is automatically instructed. As a result, a yellow dot pattern as shown in FIG. 7 can be formed.

After the yellow component printing process has been completed, the controller 9 prepares for performing a process for printing magenta components. The controller 9 causes the line memory 3 to store magenta image data for one line. Simultaneously, the controller 9 makes a reference to data stored in the memory 9*a* to recognize the printing mode set for the magenta component printing process. Since the second printing mode is selected in this embodiment, the controller 9 supplies, as selection signals, "0", "0" and "1" to the second selector 15, the fourth selector 19 and the fifth selector 21. As described above, the controller 9 makes a reference to printing mode data previously stored in the memory 9*a* so that the printing mode is automatically instructed. As a result, a magenta dot pattern as shown in FIG. 5 can be formed.

After the magenta component printing process has been completed, the controller 9 prepares for performing a process for printing cyan components. The controller 9 causes the line memory 3 to store cyan image data for one line. Simultaneously, the controller 9 makes a reference to data stored in the memory 9*a* to recognize the printing mode set for the magenta component printing process. Since the third printing mode is selected in this embodiment, the controller 9 supplies, as selection signals, "1", "0" and "1" to the second selector 15, the fourth selector 19 and the fifth selector 21. As described above, the controller 9 makes a reference to printing mode data previously stored in the memory 9*a* so that the printing mode is automatically instructed. As a result, a cyan dot pattern as shown in FIG. 6 can be formed.

As a result, a color image expressed by the yellow dot pattern shown in FIG. 7, the magenta dot pattern shown in FIG. 5 and the cyan dot pattern shown in FIG. 6 is recorded on the printing sheet.

7. Effects Obtainable from the Present Invention

The recording apparatus according to the present invention for recording, on a printing sheet, an image corresponding to supplied image data, comprising: head operation means for controlling operation timing and operation period of time of heat generating devices arranged in the main scanning direction of a thermal head in accordance with the depth of image data to be printed; conveyance means for conveying the printing sheet in the sub-scanning direction relatively to the thermal head; and a controller for controlling the head operation means and the conveyance means in such a manner that the position of a dot to be formed in one pixel area of a line in the main scanning direction of the printing sheet is inverted for each dot. A recording apparatus according to the present invention for recording, on a printing sheet, an image corresponding to supplied image data, the recording apparatus comprising: head operation means for controlling operation timing and operation period of time of heat generating devices arranged in the main scanning direction of a thermal head in accordance with the depth of image data to be printed; conveyance means for conveying the printing sheet in the sub-scanning direction relatively to the thermal head; and a controller for controlling the head operation means and the conveyance means in such a manner that the direction of arrangement of dots which are formed in a case where image data having a predetermined depth is printed on the printing sheet is different from the main scanning direction.

Even if the printing sheet feeding apparatus encounters displacement and the position of the printing sheet with respect to a thermal head is displaced, the foregoing structure causes dots to be formed in a zigzag configuration for the lines in the main scanning direction of the printing sheet on which a dot pattern has been formed in accordance with image data so that generation of moire fringes in the main scanning direction is prevented.

A recording apparatus according to the present invention has a first printing mode for forming a first dot pattern having a dot arrangement in substantially the sub-scanning direction, a second printing mode for forming a second dot pattern having a dot arrangement making a second angle from the main scanning direction, a third printing mode for forming a third dot pattern having a dot arrangement making a third angle from the main scanning direction, and a fourth printing mode for forming a fourth dot pattern having a dot arrangement making a fourth angle from the main scanning direction. The controller is further provided with storage means for storing printing process data denoting a printing process corresponding to one color component of a plurality of color components to be printed and printing mode data denoting one of a printing mode among the plural printing modes while making data items to correspond to each other. A required printing mode can arbitrarily be selected from a plurality of printing modes for the printing processes for printing yellow, magenta and cyan color components. Moreover, generation of moire fringes in the main scanning direction can be prevented and change in the hue can be restrained without deterioration in the resolution of the recorded dots even if the position of the magenta dot or the cyan dot is displaced with respect to the position of the yellow dot.

The recording method according to the present invention comprises the steps of: forming a first dot pattern having first color component dots arranged in a direction making a first angle from the main scanning direction; forming a second dot pattern having second color component dots arranged in a direction making a second angle, which is different from the first angle, from the main scanning direction; and forming a third dot pattern having third color component dots arranged in a direction making a third angle, which is different from the first angle and the second angle, from the main scanning direction. Therefore, generation of moire fringes in the main scanning direction can be prevented and change in the hue can be restrained without deterioration in the resolution of the recorded dots even if the position of the magenta dot or the cyan dot is displaced with respect to the position of the yellow dot.

According to the present invention, the number of heat generating devices of the thermal head which must be supplied with electric power can be halved when an image having a depth lower than a half tone is formed. Therefore, the synthetic resistance of the devices can be reduced and common drop, the voltage drop attributable to the resistance of the power source harness or the like cannot be ignored, can be prevented.

What is claimed is:

1. A thermal transfer recording apparatus for recording, on a printing sheet, an image corresponding to supplied image data, comprising:

head operation means for controlling operation timing and operation period of time of heat generating devices arranged in the main scanning direction of a thermal head in accordance with the density of image data to be printed;

conveyance means for conveying the printing sheet in the sub-scanning direction relatively to the thermal head; and a controller for controlling a start timing of a dot forming period by said head operation means according to a density of the dot so that the dot position within one pixel area is inverted for adjacent dots, thereby resulting in a predetermined angle being generated between said adjacent dots relative to the sub-scanning direction.

2. A thermal transfer recording apparatus according to claim 1, wherein said controller further controls said head operation means and said conveyance means in such a manner that the position of a dot to be formed in one pixel area of a line in the sub-scanning direction of the printing sheet is inverted for each dot.

3. A thermal transfer recording apparatus according to claim 1, wherein said thermal transfer recording apparatus is provided with a normal printing method of forming normal dots by forming dots on the basis of either side in the one pixel area and an inversion printing method of forming dots at positions opposing to the positions of the dots formed by said normal printing method by forming dots on the basis of another side in the one pixel area, and said controller controls said head operation means to switch said normal printing method and said inversion printing method with a predetermined sequence in response to a pixel clock so as to form a dot pattern having a predetermined dot arrangement direction.

4. A thermal transfer recording apparatus according to claim 1, wherein said thermal transfer recording apparatus is provided with a normal printing method for controlling timing at which the operation of each of the heat generating devices is completed in accordance with the depth of supplied pixel data and an inversion printing method for controlling the timing at which the operation of each of the heat generating devices is started in accordance with the depth of the supplied image data, and said controller switches the normal printing method and the inversion printing method for each dot so as to form a zigzag dot pattern on the printing sheet.

5. A thermal transfer recording apparatus according to claim 1, wherein said thermal transfer recording apparatus has a first printing mode for forming a first dot pattern having a dot arrangement in substantially the sub-scanning direction, a second printing mode for forming a second dot pattern having a dot arrangement making a second angle from the main scanning direction, a third printing mode for forming a third dot pattern having a dot arrangement making a third angle from the main scanning direction, and a fourth printing mode for forming a fourth dot pattern having a dot arrangement making a fourth angle from the main scanning direction.

6. A thermal transfer recording apparatus according to claim 5, wherein said second dot pattern is a dot pattern in which the position of the recorded dot is inverted for each dot in the line in the main scanning direction, said third dot pattern is a dot pattern in which the position of the recorded dot is inverted for each two dots in the line in the main scanning direction, and said fourth dot pattern is a dot pattern in which the position of the recorded dot is inverted for each dot in the line in the main scanning direction and the position of the recorded dot is inverted for each dot in the line in the sub-scanning direction.

7. A thermal transfer recording apparatus according to claim 5, wherein said controller is further provided with storage means for storing printing process data denoting a printing process corresponding to one color component of a plurality of color components to be printed and printing mode data denoting one of a printing mode among the plural printing modes while making data items to correspond to each other.

8. A thermal transfer recording apparatus according to claim 7, wherein printing mode data is data set for each color component by an operator.

9. A thermal transfer recording apparatus according to claim 7, wherein said controller controls said head operation means in accordance with printing process data and printing mode data stored in said storage means.

10. A thermal transfer recording apparatus according to claim 7, wherein said controller controls said head operation means to select a printing mode corresponding to a color component to be printed in accordance with printing mode data stored in said storage means so as to form a dot pattern corresponding to the selected printing mode when the color component denoted by printing process data is printed.

11. A thermal transfer recording apparatus according to claim 7, wherein said controller selects at least one printing mode from the plural printing modes in accordance with data stored in said storage means, and controls said head operation means to form a dot pattern corresponding to the selected printing method.

12. A thermal transfer recording apparatus according to claim 7, wherein said thermal transfer recording apparatus is provided with a normal printing method for controlling the timing at which the operation of each of the heat generating devices is completed in accordance with the depth of supplied image data, and an inversion printing method for controlling the timing at which the operation of each of the heat generating devices is started in accordance with the depth of supplied image data.

13. A thermal transfer recording apparatus according to claim 1, wherein said head operation means has gradient data generating means for generating gradient data which is sequentially increased under control of said controller and inverted gradient data formed by inverting the bit of gradient data, selection means for selecting the gradient data or inverted gradient data under control of said controller, and comparison means for comparing the gradient of the data selected by said selection means and that of image data to be printed, and the timing at which each of said heat generating devices is operated and the time period in which each of said heat generating devices is operated are controlled in accordance with a result of comparison performed by said comparison means.

14. A thermal transfer recording apparatus according to claim 13, wherein said selection means has first selection means for selecting the gradient data or inverted gradient data, second selection means which selects one-dot inverted data in which the bit is inverted for each bit or two-dot inverted data in which the bit is inverted for each two bits in accordance with a selection signal supplied from said controller so as to transmit the selected data as second selection data, bit inversion means for inverting the bit of the second selection data selected by said second selection means, third selection means which selects the second selection data selected by said second selection means or second selection data inverted by said bit inversion means so as to transmit selected data as third selection data, fourth selection means for selecting the third selection data selected by said third selection means or data "0" in accordance with a selection signal supplied from said controller, and fifth selection means which selects one-dot inverted data, which has been generated from a print pulse supplied from said controller and having one period which is one line, and the bit of which is inverted for each line or data "0" in accordance with a selection signal supplied from said controller to supply, to said third selection means, the selected data as a selection signal.

15. A thermal transfer recording apparatus according to claim 14, wherein said controller supplies selection signals to said second, fourth and fifth selection means in such a manner that said fourth selection means always selects said one-dot inverted data in the case of said second printing mode, said fourth selection means always selects said two-dot inverted data in the case of said third printing mode, and said fourth selection means transmits one-dot inverted data, the bit of which has been inverted by said inversion means for each line, in the case of said third printing mode.

16. A recording apparatus for recording, on a printing sheet, an image corresponding to a supplied image data, said recording apparatus comprising:

head operation means for controlling operation timing and operation period of time of heat generating devices arranged in the main scanning direction of a thermal head in accordance with the density of image data to be printed;

conveyance means for conveying the printing sheet in the sub-scanning direction relatively to the thermal head at a substantially constant speed; and a controller for controlling a start timing of a dot forming period by said head operation means according to a density of the dot such that the direction of arrangement at which dots are formed, where image data having a predetermined density is printed on the printing sheet, is different than in the main scanning direction, said direction of arrangement allowing for an angle to be generated between at least two dots and said sub-scanning direction.

17. A recording apparatus according to claim 16, wherein said recording apparatus is provided with a normal printing method for controlling timing at which the operation of each of the heat generating devices is completed in accordance with the depth of supplied pixel data and an inversion printing method for controlling the timing at which the operation of each of the heat generating devices is started in accordance with the depth of the supplied image data, and said controller switches said normal printing method and said inversion printing method with a predetermined sequence in accordance with data stored in said recording means so as to form a dot pattern having a dot arrangement direction which is different from the main scanning direction.

18. A recording apparatus according to claim 16, wherein the dot pattern which is formed on the printing sheet consists of a first dot pattern in which first color component dots are arranged in a direction making a first angle from the main scanning direction, a second dot pattern in which second color component dots are arranged in a direction making a second angle which is different from said first angle, and a third dot pattern in which third color component dots are arranged in a direction making a third angle from the main scanning direction, the direction being different from said first angle and said second angle.

19. A recording apparatus according to claim 16, wherein said recording apparatus has a first printing mode for forming a first dot pattern having a dot arrangement in substantially the sub-scanning direction, a second printing mode for forming a second dot pattern having a dot arrangement making a second angle from the main scanning direction, a third printing mode for forming a third dot pattern having a dot arrangement making a third angle from the main scanning direction, and a fourth printing mode for forming a fourth dot pattern having a dot arrangement making a fourth angle from the main scanning direction.

20. A recording apparatus according to claim 19, wherein said second dot pattern is a dot pattern in which the position of the recorded dot is inverted for each dot in the line in the main scanning direction, said third dot pattern is a dot pattern in which the position of the recorded dot is inverted for each two dots in the line in the main scanning direction, and said fourth dot pattern is a dot pattern in which the position of the recorded dot is inverted for each dot in the line in the main scanning direction and the position of the recorded dot is inverted for each dot in the line in the sub-scanning direction.

21. A recording apparatus according to claim 19, wherein said controller is further provided with storage means for storing printing process data denoting a printing process corresponding to one color component of a plurality of color components to be printed and printing mode data denoting one of a printing mode among the plural printing modes while making data items to correspond to each other.

22. A recording apparatus according to claim 21, wherein said controller controls said head operation means in accordance with printing process data and printing mode data stored in said storage means.

23. A recording apparatus according to claim 21, wherein said controller controls said head operation means to select a printing mode corresponding to a color component to be printed in accordance with printing mode data stored in said storage means so as to form a dot pattern corresponding to the selected printing mode when the color component denoted by printing process data is printed.

24. A recording method for recording an image corresponding to supplied image data on a printing sheet by operating a recording head having a plurality of heads arranged in the main scanning direction, said recording method comprising the steps of:

(a) conveying the printing sheet in the sub-scanning direction relative to said recording head at a substantially constant rate; and (b) controlling the start timing of the operation of heat generating devices arranged in the main scanning direction of said recording head and a period of time in which the heat generating devices are operated in accordance with the density of image data to be printed such that a dot pattern is formed in which dots to be formed; where image data having a predetermined density is printed on the printing sheet, are arranged in a direction which is different than in the main scanning direction, said direction of arrangement allowing for an angle to be generated between at least two dots and said sub-scanning direction.

25. A recording method according to claim 24 according to claim 24, wherein recording method is provided with a normal printing method for controlling timing at which the operation of each of the heat generating devices is completed in accordance with the depth of supplied pixel data and an inversion printing method for controlling the timing at which the operation of each of the heat generating devices is started in accordance with the depth of the supplied image data, and the operation timing and operation period of time of said heat generating devices arranged in the main scanning direction of said recording head are controlled in said step (b) to form a dot pattern having dots arranged in a direction which is different from the main scanning direction by switching the normal printing method and the inversion printing method with a predetermined sequence.

26. A recording method according to claim 24, wherein said recording method is provided with a first printing mode for forming a first dot pattern having a dot arrangement in substantially the sub-scanning direction, a second printing mode for forming a second dot pattern having a dot arrangement making a second angle from the main scanning direction, a third printing mode for forming a third dot pattern having a dot arrangement making a third angle from the main scanning direction, and a fourth printing mode for forming a fourth dot pattern having a dot arrangement making a fourth angle from the main scanning direction.

27. A recording method for recording an image corresponding to a supplied image data on a printing sheet by operating a recording head having a plurality of heads arranged in the main scanning direction, said recording method comprising the steps of:

forming a first dot pattern having the first color component dots arranged in a direction making a first angle from the main scanning direction according to a density of dots in said first dot pattern;

forming a second dot pattern having second color component dots arranged in a direction making a second angle, which is different from said first angle, from the main scanning direction according to a density of dots in said second dot pattern; and forming a third dot pattern having third color component dots arranged in a direction making a third angle, which is different from said first angle and said second angle, from the main scanning direction according to a density of dots in said third dot pattern.

28. A printing sheet on which a dot pattern corresponding to supplied image data is formed by operating a recording head in accordance with the density of the supplied image data while conveying the printing sheet in the sub-scanning direction with respect to the recording head having a plurality of head devices arranged in the main scanning direction, wherein the dot pattern which is formed on the printing sheet has:

a first dot pattern in which first color component dots are arranged in a direction making a first angle from the main scanning direction according to a density of dots in said first dot pattern, a second dot pattern in which second color component dots are arranged in a direction making a second angle which is different from said first angle according to a density of dots in said second dot pattern, and a third dot pattern in which third color component dots are arranged in a direction making a third angle from the main scanning direction according to a density of dots in said third dot pattern, the direction being different from said first angle and said second angle.

* * * * *